US010928151B2

(12) United States Patent
Isch

(10) Patent No.: US 10,928,151 B2
(45) Date of Patent: Feb. 23, 2021

(54) PORTABLE WEAPON REST

(71) Applicant: Bryce Isch, Warsaw, IN (US)

(72) Inventor: Bryce Isch, Warsaw, IN (US)

( * ) Notice: Subject to any disclaimer, the term of this patent is extended or adjusted under 35 U.S.C. 154(b) by 0 days.

(21) Appl. No.: 16/159,489

(22) Filed: Oct. 12, 2018

(65) Prior Publication Data

US 2019/0120586 A1 Apr. 25, 2019

Related U.S. Application Data

(60) Provisional application No. 62/575,401, filed on Oct. 21, 2017.

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/18; F16B 41/002; A01M 31/02
USPC ..... 248/176.1, 413, 448, 122.1, 126, 219.3, 248/319.4, 216.1, 214; 411/999; 42/94; 211/85.11; 89/37.01
See application file for complete search history.

(56) References Cited

U.S. PATENT DOCUMENTS 776,764 A * 12/1904 Squire ..... F16B 2/18 182/188
918,070 A * 4/1909 Menge ..... F24B 1/205 126/152 R
1,722,402 A * 7/1929 Veilleux ..... A01G 23/099 182/187
3,394,747 A * 7/1968 Duffy ..... F16B 39/10 411/353
3,746,294 A * 7/1973 Johnston ..... F21V 21/108 248/219.4
4,409,907 A * 10/1983 Norton ..... A47B 5/02 108/152
4,700,807 A * 10/1987 Kubiak ..... A63B 27/00 182/189
4,744,537 A * 5/1988 Buckley ..... F16M 13/022 211/107
5,310,151 A * 5/1994 Engel ..... F21V 21/08 248/219.4
5,482,241 A 1/1996 Oglesby
5,596,830 A 1/1997 Morgan
(Continued)

*Primary Examiner* — Kimberly T Wood
(74) *Attorney, Agent, or Firm* — Askew Intellectual Property, LLC

(57) ABSTRACT

A modular gun rest has a mounting bracket assembly and a rest assembly. The rest assembly is removably attached to the mounting bracket assembly, which is in turn attached to a tree or other surface. The rest assembly has a camouflaged outer core, which may be constructed from polyurethane foam using a silicon mold, and an inner supporting element. The mounting bracket assembly and/or the rest assembly may include an articulating joint, and may be interchangeable with multiple rest assemblies, and vice versa. When assembled, the gun rest provides a stable, non-marring, and naturally appearing surface upon which to rest a gun. A hunter may affix multiple mounting bracket assemblies in the field, and may then use a single rest assembly in conjunction with the multiple mounting bracket assemblies. Additionally, the hunter may even be provided with multiple rest assemblies, according to the species of trees that are present.

9 Claims, 4 Drawing Sheets

(56) References Cited

U.S. PATENT DOCUMENTS 5,622,342 A * 4/1997 Mills ..... F16M 11/42 248/126
5,626,322 A * 5/1997 Braun ..... F16M 11/10 248/274.1
5,677,017 A * 10/1997 Freeman ..... F41H 3/00 428/17
5,685,103 A * 11/1997 Wiggins ..... F41A 23/18 211/64
5,692,716 A * 12/1997 Himmelsbach ..... F41B 5/14 135/16
5,723,808 A 3/1998 Devall
5,769,372 A * 6/1998 Klosterman ..... F41B 5/1446 248/217.3
5,778,590 A * 7/1998 Browning ..... B32B 27/08 42/96
5,806,508 A * 9/1998 Stempien ..... F41B 5/14 124/86
5,857,651 A * 1/1999 Kunevicius ..... F41B 5/14 248/218.4
5,881,837 A * 3/1999 Leicht ..... A63B 27/00 182/90
5,899,124 A * 5/1999 Cross, Jr. ..... B25B 13/5091 81/124.4
5,967,475 A * 10/1999 Johnson ..... F41B 5/14 124/88
6,059,240 A * 5/2000 Gorsuch ..... F41B 5/14 124/86
6,202,866 B1 * 3/2001 Shea ..... A47F 5/0006 211/103
6,202,964 B1 * 3/2001 Thornhill ..... A01M 31/02 248/219.4
6,272,785 B1 * 8/2001 Mika ..... F41A 23/14 42/94
6,349,905 B1 * 2/2002 Mills ..... F16M 11/14 248/126
6,478,272 B1 * 11/2002 McKinsey ..... A01M 31/02 248/216.1
6,726,162 B1 * 4/2004 Winter ..... A01M 31/00 248/218.4
6,811,835 B1 * 11/2004 Parietti ..... F41H 3/00 428/17
7,063,188 B1 * 6/2006 Liles ..... A01M 31/02 182/134
D571,687 S * 6/2008 Spencer ..... D11/117
7,454,859 B2 11/2008 Buckner
7,690,698 B1 * 4/2010 Curran ..... F16L 21/005 285/366
7,805,788 B1 * 10/2010 Proctor ..... A61G 7/0755 5/648
8,087,195 B2 1/2012 Minges
8,231,095 B2 * 7/2012 Bean ..... F41B 5/14 248/316.8
8,302,922 B1 * 11/2012 Robinson ..... A47G 25/08 211/107
8,683,909 B1 * 4/2014 Copus ..... F41A 23/16 182/127
8,863,900 B1 * 10/2014 Bolinger ..... A63B 27/00 182/151
9,068,788 B2 6/2015 Brown
9,429,381 B1 8/2016 Kocmich, IV
9,593,903 B1 * 3/2017 Sanchez ..... F41B 5/1453
10,098,396 B1 * 10/2018 Ochoa ..... A41G 1/007
2002/0184692 A1 * 12/2002 Mullis ..... F41A 23/02 2/16
2003/0038218 A1 * 2/2003 Eppard ..... A01M 31/025 248/219.4
2004/0182803 A1 * 9/2004 Lay ..... B68C 1/002 211/85.11
2005/0188595 A1 * 9/2005 Lackey ..... F41A 23/04 42/94
2005/0246935 A1 * 11/2005 Northrup ..... F41A 23/02 42/94
2007/0004520 A1 * 1/2007 Whitmire ..... F41B 5/06 463/47.6
2007/0205344 A1 * 9/2007 Liermann ..... A01M 31/02 248/217.3
2008/0283335 A1 * 11/2008 Salerno ..... A63B 27/00 182/133
2009/0064560 A1 * 3/2009 Saunders, III ..... F41A 23/18 42/94
2010/0018102 A1 * 1/2010 Minges ..... A01M 31/02 42/94
2010/0040360 A1 * 2/2010 Scott ..... F16M 11/10 396/428
2010/0072339 A1 * 3/2010 Powell ..... B44C 5/06 248/231.91
2011/0049315 A1 * 3/2011 Buckbee ..... A01K 97/00 248/219.4
2011/0265367 A1 * 11/2011 Saunders, III ..... F41A 23/18 42/94
2011/0302819 A1 * 12/2011 McGhan ..... F41A 23/18 42/94
2011/0308887 A1 * 12/2011 Johnson ..... A01M 31/02 182/187
2012/0017485 A1 1/2012 Kern
2012/0119044 A1 * 5/2012 Wilson ..... A01M 31/02 248/219.4
2012/0174904 A1 * 7/2012 Greenhoe ..... F41B 5/1426 124/89
2015/0101233 A1 * 4/2015 Brown ..... F41A 23/16 42/94
2018/0045366 A1 * 2/2018 Perez ..... F16M 13/022

* cited by examiner

PORTABLE WEAPON REST

CROSS-REFERENCE TO RELATED APPLICATIONS

The present application claims priority to U.S. Provisional No. 62/575,401, filed Oct. 21, 2017, the entire contents of which are incorporated herein by reference.

BACKGROUND

Field of Invention

Embodiments described herein generally relate to apparatuses used to facilitate the aiming of weapons when hunting; and more particularly, to apparatuses upon which weapons can be placed that are safe, effective, and economical, while presenting a camouflaged appearance to the hunted animal, and while preventing any marring of the weapon.

Related Art

Having the ability to hold a weapon steady when attempting to aim at a target is challenging, yet critical to the intended result. Unless the weapon is supported, multiple factors can cause difficulty in aiming the weapon. Such factors include wind, elevation, the physical condition of the user, distance from the target, and etcetera. It is known in the art to provide various rests for weapons. Such rests include simple vertical braces known as "shooting sticks", horizontal and vertical rests mounted to ground or tree stands, slings to support weapons, and etcetera.

Disadvantages of weapon rests known in the art include, but are not limited to, inconsistent resting positions, lack of portability, and unnatural appearances. With regard to such "unnatural appearances," it is beneficial while hunting, for example, to blend in with the environment as much as possible.

What is needed in the art is a weapons rest that is consistent, portable, and appears to be natural in an outdoor environment.

SUMMARY

Embodiments described herein relate to a Portable Weapon Rest that can be attached to a tree or other surface. The Portable Weapon Rest is portable and can be easily transferred from one location to another. Furthermore, the Portable Weapon Rest is modular, so that the mounting bracket assembly is interchangeable with multiple rest assemblies, and vice versa. The Portable Weapon Rest is natural in appearance when used in an outdoor environment, thereby presenting a non-threatening appearance to wildlife and game. In certain embodiments, the Portable Weapon Rest may pivot or articulate on one or more axes. When assembled, the Portable Weapon Rest provides a stable, naturally appearing surface upon which to rest a gun or other object.

More specifically, the Portable Weapon Rest includes a mounting bracket assembly and a rest assembly. The rest assembly includes an outer core, and an inner supporting rod. Part of the inner supporting rod is used to couple the rest assembly to the mounting bracket assembly. The outer core resembles an object found in nature, such as a tree limb. The outer core may be constructed from polyurethane foam or any other material which may allow deformation to securely and quietly support a stock of a gun or other object. The outer core may also be constructed of a solid substrate underneath the foam, in order to provide strength and rigidity. A silicon mold, as a non-limiting example, may be used to create the outer core. The outer core can be any color, diameter, length, or shape to accommodate the user's needs.

The mounting bracket assembly includes a vertical member with a fixation feature and a fastener, and a horizontal member fixedly attached and perpendicular to the vertical member. The fastener may pass freely through the fixation feature, so that it may be turned independently of the vertical member of the mounting bracket assembly, or the fastener may be pressed into the fixation feature, welded to the vertical member, or otherwise fixedly attached to the vertical member. If fixedly attached to the vertical member, the fastener is turned together with the mounting bracket assembly, which may be used during installation as a turning handle. The fastener may alternatively be a strap, in which case the fixation feature would be at least one through slot, or any other device capable of securing the mounting bracket assembly. The mounting bracket assembly, except for the part of the horizontal member that engages with the inner supporting rod of the rest assembly, may also be enclosed in a camouflaged outer covering similar to the outer core of the rest assembly.

The portable weapon rest is assembled by removably coupling the rest assembly to the horizontal member of the mounting bracket assembly, which may be accomplished by inserting part of the inner supporting rod into the horizontal member or vice versa. A pin, such as a hairpin cotter pin, split pin, lynch pin, circle cotter, hairpin clip, or spring loaded ball lock (cotter-less) pin, may be used to secure the inner supporting rod to the horizontal member. Further, the inner supporting rod may itself be provided with a resilient attachment device, such as a spring loaded ball or snap button, thereby eliminating the need for a separate pin. In this way, a hunter may affix the mounting bracket assembly of the portable weapon rest to a tree or other supporting surface, and leave the mounting bracket assembly in place while not in use, as will be explained in further detail. The horizontal member may include more than one segment which articulates and locks into position to provide a desired configuration or position of the rest assembly. Alternatively, or in addition, the rest assembly itself can include articulating features which allow swiveling or pivoting, which then may be capable of locking into place.

According to one embodiment of the Portable Weapon Rest, an apparatus upon which to rest an object includes a mounting bracket assembly. The mounting bracket assembly has a vertical member with a fixation feature located on one end. A horizontal member is fixedly attached and perpendicular to the vertical member. A fastener is engaged with the fixation feature. A rest assembly is removably attached to the horizontal member of the mounting bracket. The rest assembly has a camouflaged outer core and an inner supporting element.

According to another embodiment of the Portable Weapon Rest, a gun rest includes a mounting bracket assembly. The mounting bracket assembly has a vertical member with a fixation feature located on one end. A horizontal member is fixedly attached and perpendicular to the vertical member. A fastener is engaged with the fixation feature. A rest assembly is removably attached to the horizontal member of the mounting bracket. The rest assembly has a camouflaged outer core and an inner supporting element.

According to another embodiment of the Portable Weapon Rest, a gun rest is made by a series of steps. The first step is constructing a rest assembly by using a silicon mold to form an outer core from polyurethane foam to resemble a tree limb, and placing it over an inner supporting element. The second step is constructing a mounting bracket assembly. The mounting bracket assembly includes a vertical member with a fixation feature located on one end, and a horizontal member fixedly attached to the vertical member. The horizontal member is perpendicular to the vertical member. The third step is removably attaching the rest assembly to the horizontal member of the mounting bracket by slidably engaging the inner supporting element with the horizontal member, and retaining the inner supporting element to the horizontal member using a pin or a resilient attachment device.

There has thus been outlined, rather broadly, some features of the Portable Weapon Rest in order that the detailed description thereof that follows may be better understood and in order that the present contribution to the art may be better appreciated. There are, of course, additional features of the Portable Weapon Rest that will be described hereinafter and which may form part of the subject matter of the claims attached. In this respect, before explaining at least one embodiment of the Portable Weapon Rest in detail, it is to be understood that the Portable Weapon Rest is not limited in its application to the details of construction and to the arrangements of the components set forth in the following description or illustrated in the drawings. The Portable Weapon Rest is capable of other embodiments and of being practiced and carried out in various ways. Also, it is to be understood that the phraseology and terminology employed herein are for the purpose of descriptions and should not be regarded as limiting. As such, those skilled in the art will appreciate that the concept, upon which this disclosure is based, may readily be utilized as a basis for the designing of other structures, methods and systems for carrying out the several purposes of the Portable Weapon Rest. It is important, therefore, that the claims be regarded as including such equivalent constructions insofar as they do not depart from the spirit and scope of the Portable Weapon Rest.

An advantage of the Portable Weapon Rest is that it is portable and can be moved from location to location. Another advantage of the Portable Weapon Rest is that it is modular and can have different rests on the same mounting bracket; the different rests being of varying lengths, widths, colors, and etcetera. Another advantage of the present invention is the natural appearance of the Portable Weapon Rest will not startle or alert wildlife. Still another advantage of the Portable Weapon Rest is that the weapons rest may be constructed partially of foam or another partially resilient material that will not create noise when a weapon is placed upon it, as well as not mar the weapon. Yet another advantage of the Portable Weapon Rest is that it can be capable of being pivoted and locked in a desired orientation.

DESCRIPTION OF THE DRAWINGS

The above-mentioned and other features of embodiments of the Portable Weapon Rest, and the manner of their working, will become more apparent and will be better understood by reference to the following description of embodiments of the Portable Weapon Rest taken in conjunction with the accompanying drawings, wherein.

Corresponding reference numbers indicate corresponding parts throughout the several views. The exemplifications set out herein illustrate embodiments of the Portable Weapon Rest, and such exemplifications are not to be construed as limiting the scope of the claims in any manner.

DETAILED DESCRIPTION

Figure 1:
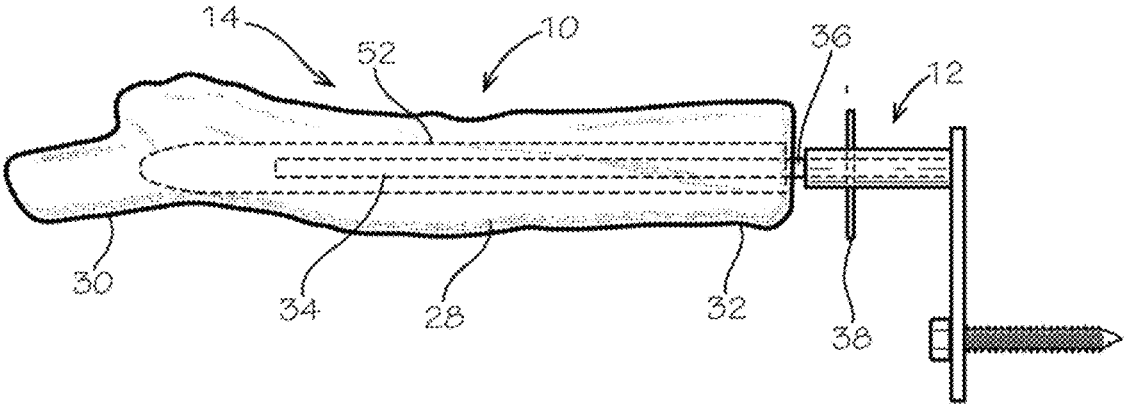
FIG. 1 is a front view of an embodiment of the Portable Weapon Rest, as described herein.

Referring now to FIG. 1, there is shown an embodiment of a portable weapon rest 10 according to the present invention. The portable weapon rest 10 includes a mounting bracket assembly 12 and a rest assembly 14. The rest assembly 14 includes an outer core 28 with a first end 30 and a second end 32, and an inner supporting rod 34 (shown dashed). A portion 36 of the inner supporting rod 34 may protrude past the second end 32 of the outer core 28. The portion 36 can be used to couple the rest assembly 14 to the mounting bracket assembly 12, as described below. The outer core 28 can resemble an object found in nature, and preferentially resembles a tree limb. The outer core 28 may be constructed from polyurethane foam or any other material which may allow deformation to securely and quietly support a stock of a gun 40 or other object. The outer core 28 may also be constructed of a solid substrate 52 underneath the foam, in order to provide strength and rigidity. A silicon mold, as a non-limiting example, may be used to create the outer core 28. The inner supporting rod 34 may be constructed of metal or any other material capable of supporting the outer core 28 and a gun 40 or other object resting upon it.

Figure 2:
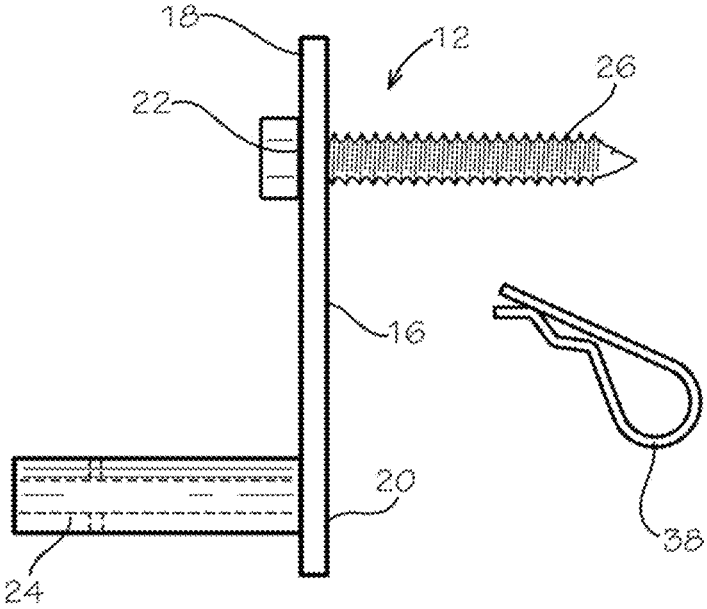
FIG. 2 is a front view of a mounting bracket assembly used in the embodiment of the Portable Weapon Rest shown in FIG. 1, as described herein.

Now referring to FIG. 2, the mounting bracket assembly 12 is described in further detail. The mounting bracket assembly 12 includes a vertical member 16 with a first end 18, a second end 20, and a fixation feature 22. The fixation feature 22 is located at or near the first end 18 of the vertical member 16. The mounting bracket assembly 12 further includes a horizontal member 24 fixedly attached and perpendicular to the second end 20 of the vertical member 16, and a fastener 26 removably attached to the vertical member 16 by the fixation feature 22. The fastener 26 may be a lag screw with an external hex drive, as shown, in which case the fixation feature 22 would be a through hole, through which the fastener 26 passes. The fastener 26 may pass freely through the fixation feature 22, so that it may be turned independently of the vertical member 16 of the mounting bracket assembly 12. Alternately, the fastener 26 may be pressed into the fixation feature 22, welded to the vertical member 16 after being passed through the fixation feature 22, or otherwise fixedly attached to the vertical member 16 in place within the fixation feature 22. In this case, the fastener is turned together with the mounting bracket assembly 12, which may advantageously be used during installation as a turning handle. The fastener 26 may alternatively be a strap, in which case the fixation feature 22 would be at least one through slot (neither shown), or any other device capable of securing the mounting bracket assembly 12.

Still referring to FIG. 2 with continued reference to FIG. 1, the portable weapon rest 10 is assembled by removably coupling the rest assembly 14 to the mounting bracket assembly 12. This is accomplished by inserting the portion 36 of the inner supporting rod 34 into the horizontal member 24 on the vertical member 16, or vice versa, with a pin 38, which is shown as a hairpin cotter pin. Attachment mechanisms other than hairpin cotter pin 38, such as a split pin, lynch pin, circle cotter, hairpin clip, or spring loaded ball lock (cotter-less) pin, may be used. Further, the portion 36 of the inner supporting rod 34 may itself be provided with a resilient attachment device, such as a spring loaded ball or snap button, thereby eliminating the need for a separate pin 38. The inner supporting rod 34 and the horizontal member 24 may both be cylindrical or both be any other shape in cross-section, as long as they are capable of being coupled.

Figure 3:
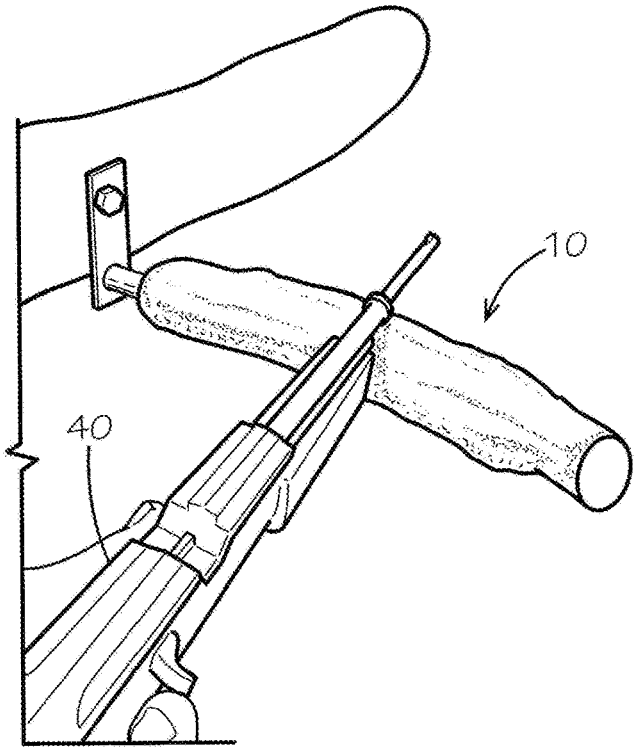
FIG. 3 is an isometric view of the embodiment of the Portable Weapon Rest, shown in use, as described herein.
Figure 4A:
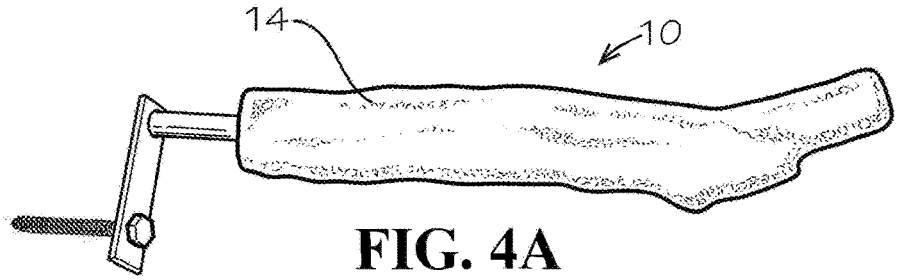
FIGS. 4A, 4B, and 4C are isometric views of alternate embodiments of the Portable Weapon Rest, as described herein.
Figure 4B:
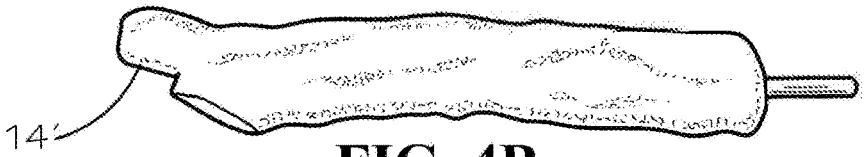
Figure 4C:
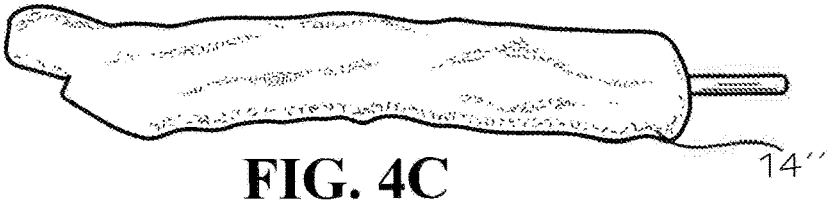

When assembled, and as seen now in FIG. 3, the portable weapon rest 10 provides a stable, naturally appearing surface upon which to rest a gun 40 or other object. Because of the removable coupling of the rest assembly 16 and the mounting bracket assembly 14, the portable weapon rest 10 can be considered to be modular in that a single rest assembly 16 can be mounted on any of several pre-mounted mounting bracket assemblies 14, and/or several different rest assemblies 14 could be mounted on one or more mounting bracket assemblies 14, as will be explained in further detail. As seen in FIG. 4, the portable weapon rest 10 can include rest assembly 14, rest assembly 14', rest assembly 14", and etcetera. The outer core 28 can be any color, diameter, length, or shape to accommodate the user's needs. It is noted that the mounting bracket assembly 12 is shown in a bare state for the purpose of illustration. However, the mounting bracket assembly 12, except for the part of the horizontal member 24 that engages with the portion 36 of the inner supporting rod 34 of the rest assembly 14, may in fact be enclosed in a camouflaged outer covering similar to the outer core 28 of the rest assembly 14.

In this way, a hunter may affix the mounting bracket assembly 12 of the portable weapon rest 10 to a tree or other supporting surface, and leave the mounting bracket assembly 12 in place while not in use. When the hunter desires to hunt, he or she may carry the rest assembly 14 into the field, and engage it with the mounting bracket assembly 12 upon arrival at the hunting site. While the outer core 28 of the rest assembly 14 is generally weatherproof, removal and storage of the rest assembly 14 when not in use minimizes sun damage and/or any animal or insect damage that may occur. Furthermore, a hunter may choose to affix multiple mounting bracket assemblies 12 in the field, according to the availability of multiple hunting sites. He or she may then use a single rest assembly 14 in conjunction with the multiple mounting bracket assemblies 12. Additionally, the hunter may even be provided with multiple rest assemblies 14, according to the species of trees that are present at the hunting sites.

Figure 5:
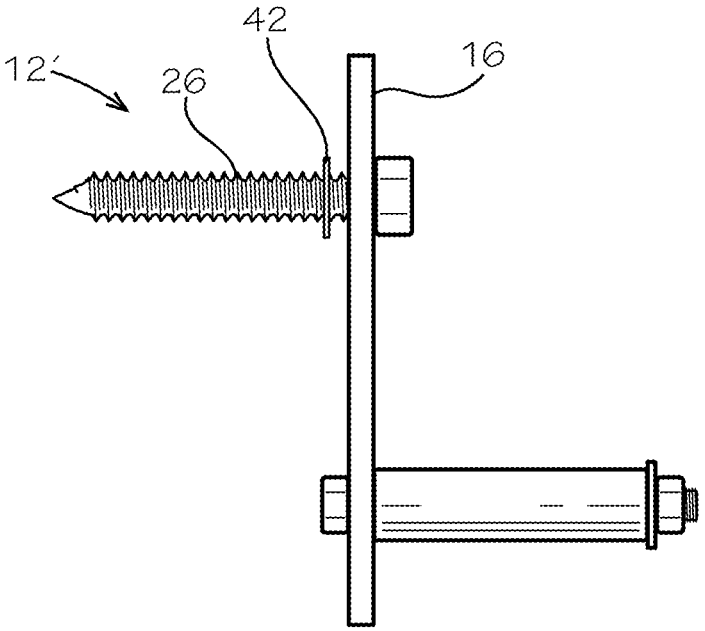
FIG. 5 is a front view of an alternate embodiment of the mounting bracket assembly used in the embodiment of the Portable Weapon Rest shown in FIG. 1, as described herein.
Figure 6:
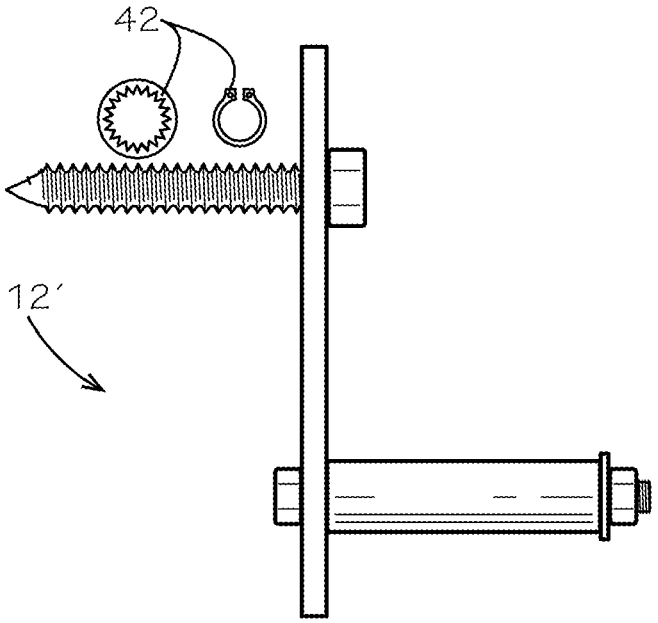
FIG. 6 is another front view of the embodiment of the mounting bracket assembly used in the embodiment of the Portable Weapon Rest shown in FIG. 1, as described herein.
Figure 7:
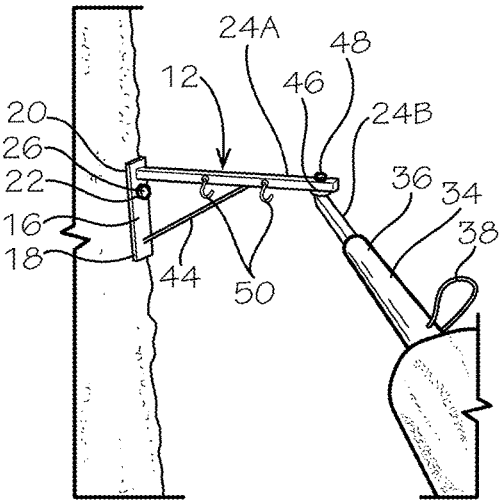
FIG. 7 is a top left view of another alternate embodiment of the Portable Weapon Rest, as described herein.
Figure 8:
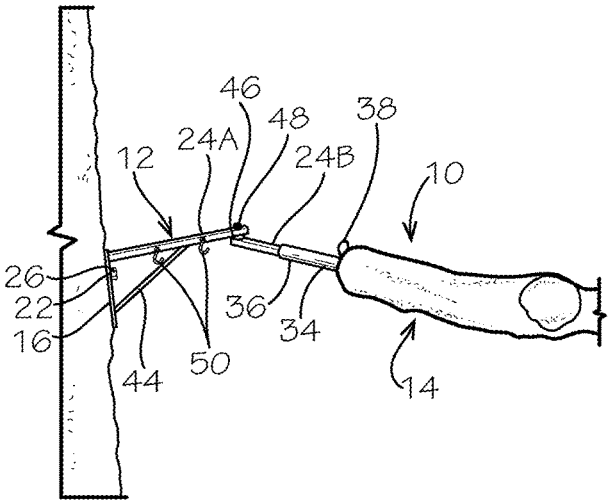
FIG. 8 is an isometric view of the embodiment of the Portable Weapon Rest shown in FIG. 7, as described herein.
Figure 9:
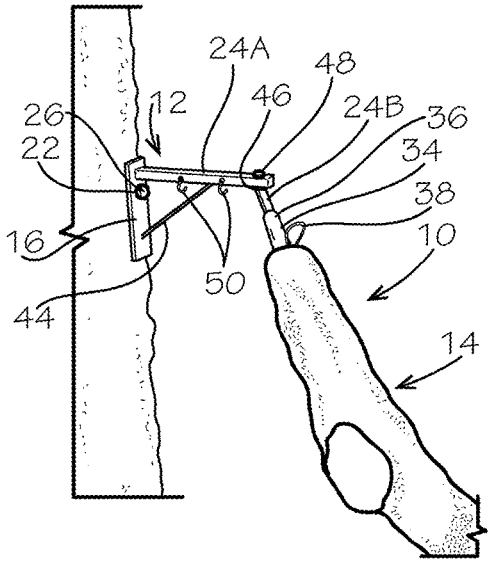
FIG. 9 is another top left view of the embodiment of the Portable Weapon Rest of FIGS. 7 and 8, as described herein.
Figure 10:
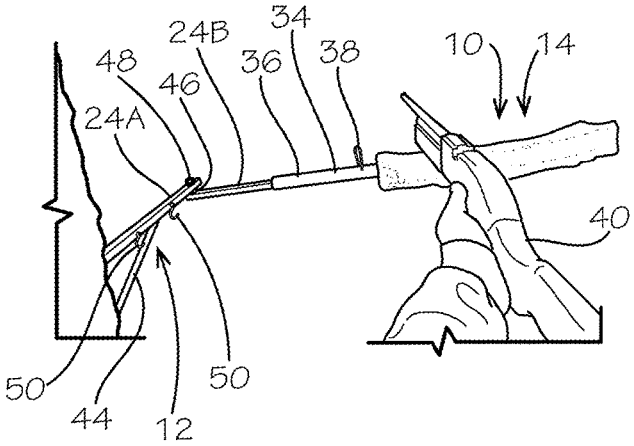
FIG. 10 is a top rear view of the embodiment of the Portable Weapon Rest of FIGS. 7, 8, and 9, shown in use, as described herein.

Now referring to FIGS. 5 and 6 with continued reference to FIG. 2, an alternative embodiment of the mounting bracket assembly 12 is shown, designated as mounting bracket assembly 12'. In this embodiment, at least one retainer 42 is located on the fastener 26. The at least one retainer 42 allows the fastener 26 to be captured within the mounting bracket assembly 12', yet also allows the vertical member 16 to be positioned in any position independent of where the mounting bracket assembly 12' is located relative to a tree or other structure upon which it is mounted. This can help eliminate under-tightening or over-tightening when installing the mounting bracket assembly 12' to a tree or other structure, which could occur when the fastener 26 is rigidly attached to the vertical member 16. The at least one retainer 42 can be a clip, ring, washer, or any other structure capable of performing its intended function.

In another embodiment, the horizontal member 24 can be comprised of more than one segment which articulates and locks into position to provide a desired configuration or position of the rest assembly 14. In the embodiment shown in FIGS. 7 through 10, the mounting bracket assembly 12 of the portable weapon rest 10 includes at least one articulating feature, in this case a horizontal member first segment 24A and a horizontal member second segment 24B. The horizontal member first segment 24A and the horizontal member second segment 24B are connected by a joint 46, which allows swiveling or pivoting of the rest assembly 14. The joint 46 may be provided with a connector 48, which may be tightened in order to lock the rest assembly 14 into place. In the embodiment of the portable weapon rest 10 shown in FIGS. 7 through 10, the joint 46 is illustrated as a pivot or hinge joint, as a non-limiting example. The joint 46, however, may be embodied as any of a number of types of joint, such as a ball and socket joint, a sliding joint, or a wrist joint, as non-limiting examples. Further, the connector 48 is illustrated as a nut and bolt, as a non-limiting example. However, the connector 48 may be embodied as any of a number of tightening mechanisms, such as a wingnut, a cam lock, or a friction lock, as non-limiting examples. Alternatively, or in addition, the rest assembly 14 itself can include articulating features which allow swiveling or pivoting, which then may be capable of locking into place.

As before, the portable weapon rest 10 is assembled by removably coupling the rest assembly 14 to the mounting bracket assembly 12. This is accomplished by inserting the portion 36 of the inner supporting rod 34 into the horizontal member second segment 24B, or vice versa, and securing it with a pin 38, which is again shown as a hairpin cotter pin. Due to the additional weight of the horizontal member first segment 24A and horizontal member second segment 24B, and the additional leverage required to support the gun 40, the mounting bracket assembly 12 may be provided with a brace 44 between the vertical member 16 and the horizontal member first segment 24A. The fixation feature 22 and fastener 26 may in this embodiment be located nearer the second end 20 of the vertical member 16, in order to minimize susceptibility of the fastener 26 to pull out of its engagement with a supporting surface.

The mounting bracket assembly 12 may be provided with one or more hooks 50 or other attachment features, for example located on one or both of the horizontal member first segment 24A or the horizontal member second segment 24B. The hooks 50 may be used for various purposes, such as tying on a flag so that the user can locate the mounting bracket assembly 12 of the portable weapon rest 10, or for mounting a game camera, as non-limiting examples. As with previous embodiments, the horizontal member first segment 24A and the horizontal member second segment 24B of the mounting bracket assembly 12, except for the part of the horizontal member second segment 24B that engages with the portion 36 of the inner supporting rod 34 of the rest assembly 14, may again be enclosed in a camouflaged outer covering (not shown for purpose of illustration) similar to the outer core 28 of the rest assembly 14.

While the Portable Weapon Rest has been described with respect to at least one embodiment, the Portable Weapon Rest can be further modified within the spirit and scope of this disclosure. With respect to the above description then, it is to be realized that the optimum dimensional relationships for the parts of the Portable Weapon Rest, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present Portable Weapon Rest. This application is therefore intended to cover any variations, uses, or adaptations of the Portable Weapon Rest using its general principles. Further, this application is intended to cover such departures from the present disclosure as come within known or customary practice in the art to which this invention pertains and which fall within the limits of the appended claims.

REFERENCE NUMBER LISTING

| | |
|---|---|
| 10 | Portable weapon rest |
| 12, 12' | Mounting bracket assembly |
| 14, 14', 14" | Rest assembly |
| 16 | Vertical member |
| 18 | First end |
| 20 | Second end |
| 22 | Fixation feature |
| 24 | Horizontal member |
| 24A | Horizontal member first segment |
| 24B | Horizontal member second segment |
| 26 | Fastener |
| 28 | Outer core |
| 30 | First end |
| 32 | Second end |
| 34 | Inner supporting rod |
| 36 | Portion |
| 38 | Pin |
| 40 | Gun |
| 42 | Retainer |
| 44 | Brace |
| 46 | Joint |
| 48 | Connector |
| 50 | Hooks |
| 52 | Solid substrate |

What is claimed is:

1. A gun rest, comprising:

a mounting bracket assembly, having:

a vertical member having a first upper end and a second lower end, the vertical member including a through hole located at the first upper end and a cylindrical horizontal member at the second lower end;

the cylindrical horizontal member rigidly attached to the vertical member in a fixed perpendicular orientation with respect to the vertical member;

a fastener inserted through the through hole;

a rest assembly having a solid deformable outer core surrounding an inner supporting element, the solid deformable outer core being constructed from molded polymer material; and the inner supporting element of the rest assembly configured to be slidably engaged with the cylindrical horizontal member, the rest assembly being retained in fixed perpendicular orientation with respect to the vertical member by way of the cylindrical horizontal member, the inner supporting element, and an attachment device that passes perpendicularly and entirely through the cylindrical horizontal member and the inner supporting element at a single fixed depth of engagement between the cylindrical horizontal member and the inner supporting element.

2. The gun rest of claim 1, wherein:

the solid deformable outer core being constructed from molded polyurethane foam; and the outer core further comprises a rigid solid substrate underneath the polyurethane foam.

3. The gun rest of claim 1, wherein:

the attachment device is one of:

a hairpin cotter pin, a split pin, a lynch pin, a circle cotter, a hairpin clip, a spring loaded ball lock pin, a spring loaded ball, and a snap button.

4. The gun rest of claim 1, wherein:

the fastener being rotatably engaged with the through hole; and further comprising at least one retainer engaged with the fastener and arranged to retain the fastener within the through hole.

5. The gun rest of claim 1, wherein:

the rest assembly being removably attached to the cylindrical horizontal member of the vertical member.

6. The gun rest of claim 1, wherein:

the fastener being non-rotatably engaged with the through hole.

7. A gun rest made by the steps of:

constructing a rest assembly by using a silicon mold to form a solid deformable outer core from polyurethane foam surrounding a rigid solid substrate, and placing the solid deformable outer core over an inner supporting element;

constructing a mounting bracket assembly, the mounting bracket assembly including:

a vertical member having a first upper end and a second lower end, the vertical member having a through hole located at the first upper end, and a fastener inserted through the through hole;

a cylindrical horizontal member rigidly attached to the vertical member at the second lower end, the cylindrical horizontal member in a fixed perpendicular orientation with respect to the vertical member;

configuring the inner supporting element of the rest assembly to be slidably engaged with the cylindrical horizontal member, and retaining the inner supporting element in fixed perpendicular orientation with respect to the vertical member by way of the cylindrical horizontal member, the inner supporting element, and an attachment device that passes perpendicularly and entirely through the cylindrical horizontal member and the inner supporting element at a single fixed depth of engagement between the cylindrical horizontal member and the inner supporting element.

8. The gun rest of claim 7, wherein:

the fastener being rotatably engaged with the through hole; and further comprising at least one retainer engaged with the fastener and arranged to retain the fastener within the through hole.

9. The gun rest of claim 7, wherein:

the fastener being non-rotatably engaged with the through hole.

* * * * *